United States Patent [19]

Preuss et al.

[11] Patent Number: 4,599,590

[45] Date of Patent: Jul. 8, 1986

[54] SWITCH WITH A SELECTIVE RELEASE

[75] Inventors: Bernhard Preuss; Karl-Heinz Manthe, both of Berlin, Fed. Rep. of Germany

[73] Assignee: Siemens Aktiengesellschaft, Berlin and Munich, Fed. Rep. of Germany

[21] Appl. No.: 684,478

[22] Filed: Dec. 21, 1984

[30] Foreign Application Priority Data

Dec. 22, 1983 [DE] Fed. Rep. of Germany ..... 3347121

[51] Int. Cl.[4] ..... H01H 71/24

[52] U.S. Cl. ..... 335/175; 335/174

[58] Field of Search ..... 335/174, 175, 172, 21, 335/22, 38, 176

[56] References Cited

U.S. PATENT DOCUMENTS 3,569,879 11/1971 Gryctko ..... 335/176

FOREIGN PATENT DOCUMENTS 2854568 6/1980 Fed. Rep. of Germany .

2945618 5/1981 Fed. Rep. of Germany .

*Primary Examiner*—Harold Broome

*Attorney, Agent, or Firm*—F. W. Powers; J. L. James

[57] ABSTRACT

A switch with a selective release having a stroke armature activated by an electromagnet in response to a release current to actuate a switch latch. A lever arrangement encloses a stroke armature in such a fashion that it can be swiveled by the stroke armature from a rest position into a position in which the stroke armature may be rapidly moved to impact on the latch.

6 Claims, 3 Drawing Figures

SWITCH WITH A SELECTIVE RELEASE

BACKGROUND OF THE INVENTION

The present invention relates to a switch with a selective release, and more particularly to a switch having a stroke armature which is activated by current corresponding to the switch release current.

In prior art switches such as that disclosed in German Patent Publication (Offenlegungsschrift) No. 2,854,568 Greefe there is a stroke armature with a selective release with spring action mounted in a moveable fashion in the interior of an electromagnetic coil. The release is further equipped with a lever arrangement which is rotatably mounted on a shaft and consists of a two-armed, L-shaped lever and a further single-armed lever which is swivel-mounted on the L-shaped lever. The two levers always form one stop for the stroke armature. In the rest position the single-armed lever is located outside the reach of the stroke armature. At the first release current pulse the stroke armature is drawn into the electromagnet coil and upon conclusion of the current pulse it swings back. The armature thereby butts against the first stop (L-shaped lever) of the lever arrangement and moves it into a position in which the second stop (single-armed lever) moves within range of the stroke armature. If a second release current pulse arises before the lever arrangement has swung back into its rest position, the stroke armature is drawn again into the coil and impacts against the single-armed lever. Due to the action of the stroke armature this lever trips and thereby actuates a latch of a current limiting switch using an additional lever. It will be appreciated that it would be highly desirable to produce a switch having a similar function but of simpler design, and fewer operating elements.

It is therefore an object of the invention to provide a switch with a selective release having the lowest possible number of moveable parts.

Another object is to provide a switch with a selective release which exhibits improved reliability.

SUMMARY OF THE INVENTION

Briefly stated, in accordance with one aspect of the invention the foregoing objects are achieved by providing a lever arrangement comprising a single lever which at rest is positioned with its second stop between a stroke armature and a release mechanism, and in its swiveled position holds the second stop outside of the path of the stroke armature in a position in which the stroke armature can act directly upon a latch to effect the opening of a circuit.

In a presently preferred, readily manufactured design of this switch the lever is formed in approximately a U-shape and has arms of different lengths, the longer arm being swivel-mounted at one end on a shaft and forming the first stop while the shorter lever arm forms the second stop.

In a further embodiment of the invention the stroke armature is designed with a substantially cylindrical shape. The electromagnet contains a coil, with the stroke armature being moveably mounted in the interior thereof along the coil shaft and between the lever stops.

This design is particularly suitable for use in systems in which short circuit currents do not assume excessively large magnitudes; due to the design of the winding as a coil in case of a short circuit by the release current a sufficiently powerful magnetic field is generated to actuate the stroke armature. Due to the moveable mounting of the stroke armature in the coil interior the design assures a particularly compact switch configuration.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which

DESCRIPTION OF A PREFERRED EMBODIMENT

Figure 2:
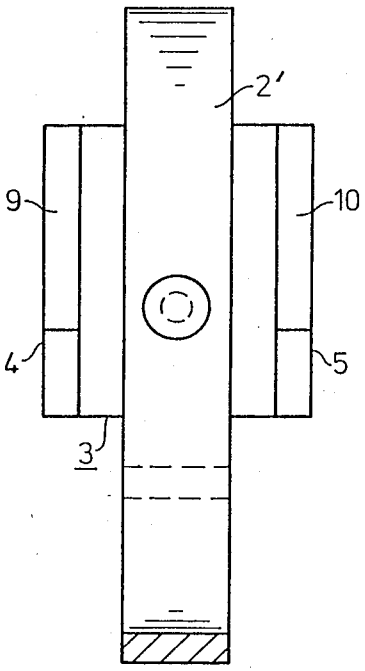
FIG. 2 is a cross section of the design of FIG. 1 taken along line II—II.
Figure 1:
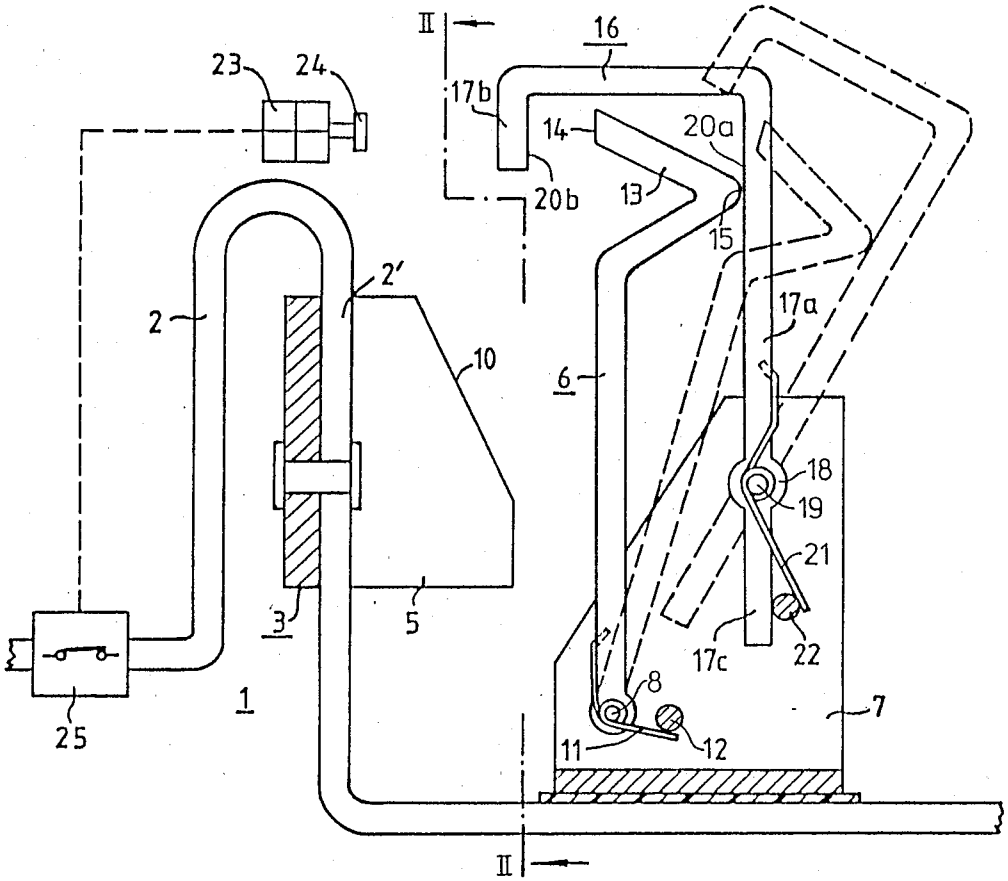
FIG. 1 illustrates one design of the switch in accordance with the invention.

The switch release depicted in FIGS. 1 and 2 comprises an electromagnet 1 with a loop-shaped bus 2 which encompasses a horseshoe shaped iron yoke 3 in such a fashion that its two arms 4 and 5 encompass therebetween a section 2' of bus 2. The switch release further contains a stroke armature 6 formed as an arm which is pivotally mounted on a rotary shaft 8 in a switch housing 7. The stroke armature 6 is aligned in such a fashion that it can be swiveled towards or away from frontal surfaces 9 and 10 of the two arms 4 and 5 of yoke 3. A slightly pre-tensioned torsion spring 11 engages the stroke armature 6 in the area of the rotary shaft 8. The spring is supported by a pin 12 which traverses the housing 8. The torsion spring 11 exerts a torque on the armature 6 which rotates the armature clockwise, away from the iron yoke 3. The armature has on its offset, free end 13 two outward-facing stop surfaces 14 and 15. At rest, the stop surface 15 of the armature bears against a lever arrangement 16. This consists of a single substantially U-shaped offset lever which, due to its U-shaped design, has two arms **17*a* and 17*b* of varying length. The longer arm 17*a* is pivoted at one end 18 on a shaft 19 in housing 7 in the plane of motion of armature 6, and forms the first stop 20*a* for stop surface 15 of the armature. The shorter arm 17*b* of the lever arrangement 16 forms a second stop 20*b* for stop surface 14 of the armature. In the area of shaft 19 the lever arrangement 16 engages a second torsion spring 21 which, in contrast to spring 11, is somewhat more heavily prestressed and is supported by a pin 22 which traverses housing 7. The second torsion spring 21 exerts a torque on the lever arrangement 16 which brings about a motion of the lever arrangement 16 such that its second stop 20***b* meets stroke armature 6. An extension 17*c* of lever arrangement 16 is pressed against a stop formed by pin 22. In this position the lever 16 encompasses armature 6 in such a fashion that the free end of the latter, with stop surfaces 14 and 15, is positioned between the stops 20*a* and 20*b* of lever 16.

The switch contains also a latch 23 with an activating element 24 mounted in the line of action of stroke armature 6 whereby the second stop 20*b* of the lever arrangement 16 is positioned between the activating element 24 and the stop surface 14 of stroke armature 6. When force is exerted on the activating element 24 the latch 23 effects the opening of the contacts of a switch 25 (not shown in detail) which is connected in circuit with bus 2. In the depicted embodiment switch 25 may be a relay, and latch 23 a source of energizing current which flows in response to the depression of element 24. Equivalently latch 23 can represent a mechanical linkage for opening switch 25 when element 24 is depressed. Such mechanisms are well known to those skilled in the art and the special form which they take is not considered germane to the operation of the present invention.

In operation when a short circuit current pulse, or the first half oscillation of a short circuit AC current of the magnitude of a release current, arises a magnetic field is generated in the loop shaped bus 2 which is concentrated in the iron yoke 3. Stroke armature 6 is moved against torsion spring 11 by the force of the resulting magnetic field in the direction of yoke 3 and latch 23. Before armature 6 attains that position, stop surface 14 impacts against the stop 20*b* of the lever arrangement 16. Since the lever arrangement is prevented by pin 22 from moving in the direction of yoke 3 it blocks any further motion of armature 6.

Upon the conclusion of the first short circuit current pulse, or following the first half oscillation of the short circuit AC current, the magnetic field breaks down and thereby its effect on the stroke armature 6 ceases. Due to the force of spring 11 the stroke armature oscillation is accelerated clockwise and due to its momentum it travels back past its normal rest position. The stop surface 15 of the stroke armature thereby contacts the first stop 20*a* of the lever arrangement 16 and drives the latter back against the spring action of torsion spring 21 from its rest position into a position which is depicted by broken lines in FIG. 1. In this position the second stop 20*b* of the lever arrangement 16 is located outside the path of stop surface 14 of stroke armature 6.

If no immediately subsequent short circuit current pulse, or no second half oscillation of the short circuit AC current, arises (for instance because a switch subordinate to the illustrated main switch has been released by the first half oscillation and thereby interrupted the current flow) then the stroke armature 6 and the lever arrangement 16 is driven by the spring 21 back into their rest positions shown by unbroken lines, and switch 25 is not activated.

If however, short circuit current continues to flow then stroke armature 6 is again attracted to yoke 3 due to the next short circuit pulse producing a magnetic field in the yoke.

The torsion springs 11 and 21 are designed in accordance with the required minimal short circuit current needed to release the switch so that the magnetic field of the short circuit current accelerates the stroke armature 6 more rapidly than torsion spring 21 can accelerate lever arrangement 16. Armature 6 then moves out from under level 16, beneath arm 17*b* to iron yoke 3 and its stop surface 13 contacts the activating element 24 of latch 23. This in turn causes the contacts of switch 25 to open. To avoid any damage to latch 23 by the stroke armature the frontal surfaces 9 and 10 of arms 4 and 5 of iron yoke 3 form an impact arrangement for engaging stroke armature 6.

Once the contacts of switch 25 open, the magnetic field in yoke 3 breaks down and stroke armature 6 moves back into its rest position under the pressure of spring 11 before the lever arrangement 16 achieves its rest position. It will be recognized by those skilled in the art that other springs, such as for example pressure or tension springs, could be used in place of the torsion springs illustrated.

It will now be appreciated that an advantage of the selective release constructed switch according to this invention is that the lever arrangement is comprised of only a single lever and is thus a particularly simple design. This is due to the fact that the lever arrangement at rest blocks the motion of the stroke armature before it can act on the release mechanism and in its swiveled position removes this blockage. Due to the simple design of the release the switch according to this invention operates with particular reliability. Reliable release of the switch is also assured by having the stroke armature act directly on the latch following a release current pulse. In addition, due to its simple design the inventive switch offers the advantage that it can be manufactured with comparatively little expense.

With the present embodiment the stroke armature is preferably designed in the form of a rotating arm whose free end is arranged to work in conjunction with the movement of the lever arrangement.

It is of particular advantage for the electromagnet to contain a bus to which an iron yoke is fastened. This design of the switch is particularly well suited for switches intended to limit high short circuit currents which generate an adequately powerful magnetic field in one current winding to actuate the stroke armature. The bus can be designed straight or in the form of a U-shaped current loop so that an advantageously compact design of the mechanism according to this invention is attained.

In this context it is of particular advantage if the iron yoke is designed in a horseshoe pattern and mounted to the current conductor in such a fashion that the frontal sides of its two arms lie transverse to the stroke armature plane of motion. Due to the horseshoe shape of the iron yoke a particularly powerful magnetic field is formed for currents of the magnitude of the release current on the frontal surfaces of both arms of the iron yoke so that a powerful attractive force impinges on the stroke armature to assure reliable actuation thereof.

Figure 3:
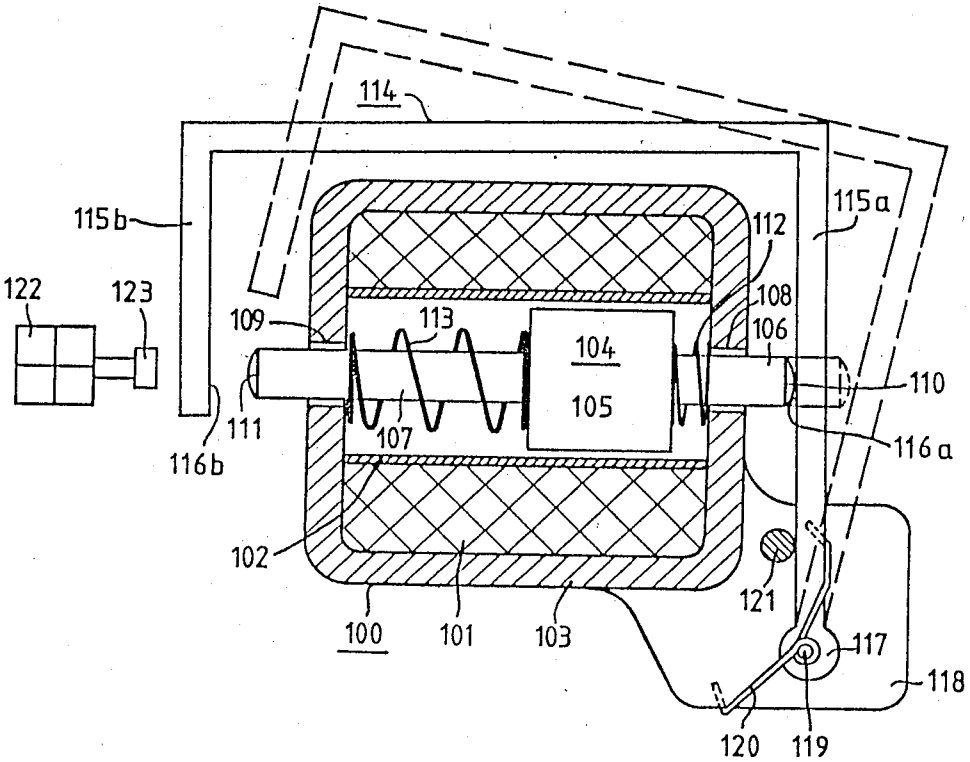
FIG. 3 shows a further embodiment of a switch of the type described, having a generally cylindrically-shaped stroke armature.

The embodiment shown in FIG. 3 shows a release switch formed in accordance with this invention including an electromagnet 100 with a coil 101 mounted on a coil core 102 and surrounded by an iron yoke 103. In the interior of the core 102 a generally cylindrically shaped stroke armature 104 is positioned and comprising of a middle section 105 with extensions 106 and 107 extending therefrom. The extensions 106 and 107 penetrate through bores 108 and 109 respectively and into the iron yoke 103. The free ends of the extensions form stop surfaces 110 and 111 of the stroke armature. In the area of its extension 106 the stroke armature 104 is biased by the first pressure spring 112 and in the area of extension 107 by another pressure spring 113 so the armature can move along the coil shaft. The release system also includes a lever arrangement 114. Like lever arrangement 16 of FIGS. 1 and 2, a single somewhat U-shaped offset lever is provided with two arms 115*a* and 115*b* of varying length. The longer arm 115*a* forms a first stop 116*a* for stop surface 110 of stroke armature 104 and the shorter arm 115*b* forms a second stop 116*b* for stop surface 111 of the stroke armature. The longer arm 115*a* is pivotally mounted at one end 117 on a shaft 119. Shaft 119 is held in place by housing 118 which extends along the plane of action of stroke armature 104. A torsion spring 120 engages the lever 114 and urges the lever when at rest counterclockwise against a stop mechanism formed by a pin 121 which traverses housing 118. In this rest position, shown in solid lines, the lever arrangement 114 encompasses the stroke armature 104 in such a fashion that its stop surfaces 110 and 111 are disposed between the stops 116*a* and 116*b* of the lever arrangement 114. In the range of movement of stroke armature 104 there is also a latch 122 with an activating element 123 so that when the lever arrangement 114 is at rest its second stop 116*b* lies between the activating element 123 of latch 122 and the stop surface 111 of the stroke armature 104.

When a first short circuit current pulse occurs the current which flows in coil 101 causes the stroke armature 104 to be drawn into the interior of the coil in the direction of latch 122. However, before the stroke armature 104 contacts the activating element 123 of latch 122 its stop surface 111 encounters the second stop 116*b* of lever 114 and its motion is blocked. Following the termination of the first short circuit current pulse the stroke armature moves back in the direction of its rest position, accelerated by pressure spring 113. Due to its momentum, stroke armature 104 moves past its rest position thereby contacting first stop 116*a* of lever 114 with its stop surface 110 the impact moves the lever clockwise against the spring force of torsion spring 120, into the position shown by the broken lines. In this position the second stop 116*b* of lever 114 is outside the path of stroke armature 104. If no immediately subsequent short circuit current pulse arises, the stroke armature 104 and the lever arrangement 114 move back into their respective rest positions in response to the biases of first pressure spring 112 and/or torsion spring 120.

If, however, a second short circuit current pulse appears then the stroke armature 104 is again drawn to the left, into the interior of coil 103. Stroke armature 104 is accelerated more rapidly by the magnetic field of coil 103 then is the lever arrangement 114 by the force of torsion spring 120. Consequently the stop surface 111 of stroke armature 104 moves past the elevated second stop 116*b* of lever 114 and contacts activating element 123 of latch 122. The impact of the stroke armature 104 thus brings about an opening of a switch (not shown) which corresponds to switch 25 of FIG. 1.

It will now be appreciated that there has been disclosed an improved system for providing a switch with a selective release which is simple, easily manufactured and quite reliable in operation.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and scope of the invention.

What is claimed as new and desired to be secured by Letter Patent of the United States is:

1. A switch with a selective release, comprising
electromagnetic means including a conductor for conducting a current;
a switch means connected in series with said conductor;
a latch coupled to said switch to control the operation thereof;
a stroke armature movably mounted adjacent said electromagnet means;
latch means for operating said latch, said latch means being disposed in the path of travel of said stroke armature;
lever means pivotally mounted adjacent said stroke armature and comprising first and second stops, said lever means being movable to a first position in which said first stop is in the path of said stroke armature and is impacted thereby when said stroke armature moves in a first direction and said second stop is interposed between said stroke armature and said latch means;
the inertias of said stroke armature and said lever means being such that upon impact of said stroke armature against said first stop the second stop of said lever means is rotated out of the path of said stroke armature to permit said stroke armature to contact said latch means.

2. A switch as defined in claim 1, wherein said lever means is formed in a U-shape to comprise a longer and a shorter arm, said longer arm forming said first stop and said shorter arm forming said second stop; and means pivotally mounting the distal end of said longer arm.

3. A switch as defined in claim 2, wherein said stroke armature comprises an arm pivotally mounted at one end, the other end thereof being movable to encounter said first and second stops.

4. A switch as defined in claim 3, wherein said conductor comprises a bus and said electromagnet comprises an iron yoke affixed to said bus.

5. A switch as defined in claim 4, wherein said yoke is formed in a generally U-shape and comprises a pair of surfaces on the parallel arms thereof which surfaces extend generally transverse to the plane of motion of said stroke armature.

6. A switch as defined in claim 2, wherein said electromagnet comprises a generally tubular opening therethrough and said stroke armature comprises a substantially cylindrical member movably disposed within said opening.

* * * * *